US007681934B2

(12) United States Patent
Harada et al.

(10) Patent No.: US 7,681,934 B2
(45) Date of Patent: Mar. 23, 2010

(54) FIBER SLING AND METHOD FOR EVALUATING ITS PERFORMANCE

(75) Inventors: Teruhisa Harada, Osaka (JP); Masaki Miura, Gamagori (JP)

(73) Assignees: Toray International, Inc., Tokyo (JP); Miura Braid Factory Co., Ltd., Aichi (JP)

( * ) Notice: Subject to any disclaimer, the term of this patent is extended or adjusted under 35 U.S.C. 154(b) by 426 days.

(21) Appl. No.: 11/665,131

(22) PCT Filed: Oct. 28, 2005

(86) PCT No.: PCT/JP2005/020242

§ 371 (c)(1),
(2), (4) Date: Apr. 11, 2007

(87) PCT Pub. No.: WO2006/049226

PCT Pub. Date: May 11, 2006

(65) Prior Publication Data

US 2008/0061572 A1 Mar. 13, 2008

(30) Foreign Application Priority Data

Nov. 2, 2004 (JP) ..... 2004-319575

(51) Int. Cl.
*B66C 1/18* (2006.01)

(52) U.S. Cl. ..... 294/74; 73/862.56

(58) Field of Classification Search ..... 294/74; 73/862.53, 862.56, 768; 116/208, 212
See application file for complete search history.

(56) References Cited

U.S. PATENT DOCUMENTS 3,463,534 A * 8/1969 Norton ..... 294/74
3,958,455 A * 5/1976 Russell ..... 73/862.68
4,757,719 A 7/1988 Franke
4,850,629 A 7/1989 St. Germain
5,651,572 A 7/1997 St. Germain
5,727,833 A * 3/1998 Coe ..... 294/74
6,422,624 B1 * 7/2002 Kauffman et al. ..... 294/74

FOREIGN PATENT DOCUMENTS

JP 63-12586 A 1/1988
JP 2-108989 U 8/1990
JP 10-250973 A 9/1998
JP 10-305987 A 11/1998
JP 2001-72383 A 3/2001
JP 2003-206085 A 7/2003
JP 2004-300609 A 10/2004

* cited by examiner

*Primary Examiner*—Dean J Kramer

(57) ABSTRACT

An object of the present invention is to enable easy and sure evaluation of practical performance of a fiber sling without taking troublesome labor such as to decompose it. As a means of achieving this object, a fiber sling according to the present invention is a fiber sling S such that: a strand 20 having a load capacity is circulated in a plurality of rows to thus form an annulus wherein the annulus is contained in a protective bag 10 having a hollow annular shape, which fiber sling S comprises: detection wires 30 each having electroconductivity and disposed in the lengthwise of the strand 20, the number of the detection wires 30 being plural and less than the total number of the rows of the strand 20; sheaths 40 covering the outer circumference of the detection wires 30; and a pair of detection terminals 32 and 32 connected electrically with the opposite ends of the plural number of detection wires 30 and exposed to the outer surface of the annular protective bag 10.

4 Claims, 2 Drawing Sheets

FIBER SLING AND METHOD FOR EVALUATING ITS PERFORMANCE

TECHNICAL FIELD

The present invention relates to a fiber sling and a method for evaluating its performance, and particularly to: a fiber sling having a whole structure of a flexible belt shape or annular shape and being used for such as lifting up and down operations of a heavy load; and a method for evaluating a performance of such a fiber sling.

BACKGROUND ART

Fiber slings are widely used as members being used in place of conventional ropes, wires, and rope slings in lifting up and down operations of heavy loads by means of a crane and the like.

Known as fiber slings having a typical structure are round slings having a structure such that: a strand such as prepared from filaments made of high-strength fibers or prepared by twisting loosely filaments is circulated into an annular arrangement as a whole in an arranged condition in many rows, and the whole annular structure constituted by the strand is covered with a protective cover made of cloth. Since such round slings are constituted flexibly as a whole, they have advantages such that a soft contact with a heavy load is possible, so that they little hurt the heavy load, and that the round slings can easily be arranged along the profile of the heavy load, and that the round slings themselves can be easily handled or carried because they are comparatively lightweight. As to such round slings, since a strand excellent in the durability to a load applied during the use, that is, load capacity, is arranged in many rows to make these rows share the load with each other, it is possible to exert a high load capacity as a whole.

As to such fiber slings, there is a case where a part of the strand constituting the fiber slings wear down or become broken as a result such as of the use of the fiber slings under a severe environment for a long period of time. If only a part of the strand is damaged, a load capacity of fiber slings does not so much decrease as a whole, so that it is possible to continue to use the fiber slings as they are. Continuing use of such fiber slings becomes impossible when the fiber slings fall into a state where a load capacity of the fiber slings decreases to such a degree that they cannot be used or where there is no sufficient scope for the capacity of the fiber slings.

In this case, however, it is difficult to look into a degree of damage to the strand contained inside the protective cover by an observation from the outside in the aforementioned structure of the fiber slings. It is a very troublesome operation to check on the inside strand after removing the protective cover. Accordingly, such operation at a job site is in lack of practicality. Under such circumstances, it is demanded to provide a technique to easily determine a degree of decrease in performance of fiber slings, namely, to determine to what degree the load capacity of fiber slings has decreased or to what degree the damage has been done to the strand.

Patent document 1 below discloses a technique such that an inspection conductor for energization is disposed inside an endless strand constituting fiber slings wherein electricity is applied across two connection terminals of the inspection conductor drawn out from the opposite ends of an endless strand. In this case, if there is a portion disconnected at a halfway of the endless strand, the inspection conductor is disconnected also, so that the energization is interrupted. Thus, as a result of the energization inspection, it can be known that there is a disconnection in the endless strand, in other words, deterioration in performance of the fiber slings. There is disclosed also a technique such that an optical conductor is used as an inspection conductor, and it is determined whether or not a light reaches from an end of the optical conductor to the opposite end thereof when the light is applied, whereby it can be known whether there is a disconnection in both the optical conductor and the endless strand or not.

Patent document 2 below discloses also a technique such that a strand of an optical fiber material is disposed in parallel to a strand of a load-bearing material both of which are contained in a cylindrical protective cover for a flexible circular sling, and a condition of the sling is inspected in accordance with whether a light is transmittable between the opposite ends of the optical fiber strand which ends are projected from the protective cover.

[Patent Document 1] Japanese Laid-Open Utility Model Application Publication No. 02-108989

[Patent Document 2] Japanese Laid-Open Patent Application Publication No. 10-305987

According to the above-described conventional techniques to know deterioration in performance of fiber slings, it is difficult to evaluate adequately performance of the fiber slings, for example, to evaluate how much the deterioration in performance of fiber slings is in detail, or to judge whether or not the fiber slings retain performance which is applicable to a practical use.

For instance, in the prior art of patent document 1 above, only one inspection conductor is disposed along the whole of one endless strand disposed through the whole fiber sling. Accordingly, if a certain position of the endless strand is damaged and the inspection conductor at that position is disconnected, energization or transmission of light is interrupted. Thus, only an alternative evaluation can be made as to performance of the fiber sling. Namely, if the inspection conductor is in a conducting state, the fiber sling functions normally and, if the inspection conductor is in a non-conducting state, the fiber sling does not function normally. In this respect, the technique of patent document 2 above is also quite the same.

However, when a strand is arranged in many rows in a fiber sling, there is a case where a total load capacity all over the fiber sling is not so much reduced if only one raw of the strand among a plurality of rows of the strand is damaged, so the fiber sling is sufficiently practicable. Since many arranged rows of the strand exert their load capacity by means of their mutual frictional bearing force, a load capacity due to the remaining rows which are not damaged is sufficiently maintained. When a fiber sling is designed, rows more than are required for providing a necessary load capacity are made to exist to thus allow a sufficient factor for safety.

According to the above-described prior art, it is judged that a fiber sling is in a malfunction state, even if only one place of an endless strand is damaged. Thus, even such a slightly damaged fiber sling must be discarded, although it retains still sufficient practical performance. Therefore, an economical loss is significant.

DISCLOSURE OF THE INVENTION

OBJECT OF THE INVENTION

Accordingly, an object of the present invention is to evaluate adequately practical performance of such a fiber sling as aforementioned, thereby resulting in extending the substantial term for use, in other words, life time, of the fiber sling.

SUMMARY OF THE INVENTION

A fiber sling according to the present invention is a fiber sling such that: a strand having a load capacity is circulated in a plurality of rows to thus form an annulus wherein the annulus is contained in a protective bag having a hollow annular shape, which fiber sling comprises: detection wires each having electroconductivity and disposed in the lengthwise of the strand, the number of the detection wires being plural and less than the total number of the rows of the strand; sheaths covering the outer circumference of the detection wires; and a pair of detection terminals connected electrically with the opposite ends of the plurality of rows of detection wires and exposed to the outer surface of the annular protective bag.

[Fiber Sling]

Basically, a material and a structure common to those of usual fiber slings can be used.

As a basic structure of the fiber sling, there is provided a structure such that a strand having a load capacity is circulated to form an annular profile as a whole in a state where the strand is arranged in a plurality of rows, and that the annulus of the strand is contained in a protective bag having a hollow annular shape. As to its detailed structure, techniques adopted for usual slings can be applied in combination if the sling is provided with such a basic structure as described above.

As the fiber sling, there are round slings and belt slings, and there are known structures of types called such as endless types and opposite-ends-I-shaped types. Basically, the present invention is applicable to any type structure of slings.

Among others, it is effective to apply the present invention to the round slings.

<Round Sling>

A basic structure of the round sling is such that a plurality of rows of the strand are circularly disposed side by side without being bound to each other. An annulus constituted by such a strand is contained in a hollow annular protective bag which is freely movable and stretchable separately from the strand. Thus, a sectional shape of the round sling is in a state where the strand is disposed in the formation irregularly dispersed inside the annular protective bag having a circular or irregular section.

It is desired that such as a selection of specific materials, a design, or manufacturing steps of the round sling are set appropriately for conditions such as purposes of application, required performance, and use environment of the round sling.

Although dimensions of the round sling differ according to purposes of application, yet, for example, the overall length can be set within a range of 0.1 to 20 m, and the maximum load capacity or the permissible applied load can be set within a range of 0.1 to 200 tons.

[Strand]

Basically, the same materials and structures as those of strands in usual fiber slings may be applied.

As materials of the strand, it is possible to use filaments prepared by drawing and arranging or twisting loosely a plurality of multifilaments of synthetic fibers made of PBO (polyparaphenylene benzoxazole), polyester, polyarylate, aramide, high strong polyethylene and the like. Carbon fibers or metallic fibers may also be used, or these fibers may be combined with synthetic fibers. Fibers to which a sufficient tensile strength and load capacity required for the fiber sling are provided are preferable.

Cargo worthiness of an annulus or fiber sling constituted by the strand varies depending upon the number of the rows of the strand. Furthermore, although it differs depending also upon the materials, the required performance and the like of the strand, yet the number of the rows of the strand can be set usually within a range of 15 to 1000.

Although one fiber sling usually comprises an annulus constituted by using only one strand and circulating it in a required number of rows, yet it may be modified in a way such that a plural number of annuluses, each of which is constituted by circulating one strand in a plural number of rows, are disposed in combination in rows. In this case, the number of the rows of the strands in the whole fiber sling corresponds to the total number of the rows of the strands in the combined strand annuluses.

[Annular Protective Bag]

The annular protective bag functions to contain, in a lump, an annulus constituted by a plural number of rows of the strand. It functions also to protect the strand from being damaged due to its direct contact with a heavy load which is to be lifted up by means of the fiber sling or with circumferential members. It can function also to protect the strand from such as sunlight under an environment of the use. The annular protective bag does not participate directly in the lifting capacity of the fiber sling. However, the protection of the strand by covering its outer circumference with the annular protective bag enhances the load capacity of the strand annulus, so that the improvement in the capacity of the sling can be achieved.

The annular protective bag may be formed of a textile fabric prepared from the same fiber material as that of the strand or from other various fiber materials. The annular protective bag may be that obtained by knitting and weaving the fiber materials into a bag shape or it is also possible to constitute the annular protective bag by rounding a band-shaped textile fabric into a cylindrical shape and then sewing or joining its side end edges together.

It is desirable for the annular protective bag to have a material or structure which is excellent in such as surface friction durability, abrasion resistance and slippage easiness or difficulty and protective function for the strand rather than in the resistance to the tensile force. It is preferred that the annular protective bag has properties suited for environment conditions during the use, such as water resistance, oil resistance, chemical resistance, and heat resistance.

As to the material of the annular protective bag, an inner layer of the bag may be prepared from a material different from that of an outer layer of the bag so as to satisfy the function demanded to each of the inner layer and the outer layer. The bag may be fabricated in a double or more multiple layered structure. For example, it is possible to use materials in combination as follows: a material excellent in such as friction resistance is used for the outer layer, and a material excellent in the ultraviolet-rays-intercepting ability and therefore excellent in the function of protecting the strand is used for the inner layer. If the color of the inner layer is made different from that of the outer layer, then it is possible to let a person easily know damage conditions by exposure of the color of the inner layer when the outer layer is damaged during the use.

The dimensions of the annular protective bag are set so as to be appropriate for a lap length of the fiber sling and for a diameter of the strand and the number of the rows of the strand to be contained in the bag. The lap length of the annular protective bag is set so as to be the same as or somewhat longer than a lap length of the strand. Hence, even if the annulus of the strand is in an elongated state, an excessive load is prevented from being applied to the annular protective bag. An inner diameter of the annular protective bag may be set in the range of 10 to 200 mm. In a flexible annular protective bag, however, a sectional shape thereof is not necessarily a circle, but it may change into such as a flat oval or oblong shape dependently on the arrangement of the strand contained inside the bag or on how the load is applied. Therefore, the aforementioned inner diameter is defined in a state where the section is assumed to be circular.

The annular protective bag may be provided with a structure needed so that: detection wires and detection terminals can be disposed or protected or a detecting operation can be made easy.

[Detection Wire]

A detection wire needs to have flexibility for becoming easily deformed in conformity with deformation of the whole sling comprising an annulus of a strand and an annular protective bag, in addition to electroconductivity. Since the detection wire itself is not required to bear a load, physical strengths such as tensile strength and bending strength are not so much required. However, the detection wire is required to exhibit more elongation than the strand.

An electroconductive material such as copper and a copper alloy may be used as a material of a detection wire. A sectional shape of the detection wire is usually a circle, but other than that, for example, an oval, oblong, angular, or flat-plate-shaped section may also be used. Characteristic properties such as electrical resistance per length, strength, flexibility and the like are influenced by a sectional area of the detection wire.

When an electroconductive metallic wire made of such as copper is used as a material of the detection wire, an outer diameter thereof may be set within a range of 0.1 to 1.0 mm, preferably 0.25 to 0.3 mm. If the electroconductive metallic wire is too thin, it is easily snapped even by usual repeating force applied to the electroconductive metallic wire during the use of the fiber sling. If the electroconductive metallic wire is too thick, it is difficult for the wire to follow the flexible deformation of the fiber sling and it is therefore easy for the wire to be snapped by the bending force applied during the use of the sling. In any case, it is difficult to sufficiently carry out the evaluation of the performance of the fiber sling.

A covered electroconductive wire wherein the outer circumference of the electroconductive metallic wire is covered with such as an insulating resin may also be used. In the case of the covered electroconductive wire, the covering thickness can, for example, be set within the range of 0.010 to 0.018 mm.

The detection wire can be continuously disposed over almost the whole circumference of a lap length of a strand annulus. The detection wire may be disposed on only a part of the strand annulus along the lap length thereof. There is also a case where detection wires are disposed on a plural number of positions spaced in the circumferential direction of a strand annulus.

It is desired to put a detection wire in condition where no excessive tensile force is applied thereto even in a state where a load is applied to the fiber sling to thus extend it, so that a lap length of the strand is prolonged due to the extension thereof. Specifically, it is effective to use a material more stretchable than the strand as a material of the detection wire. Or, alternatively, it is also effective that the detection wire is disposed so as to be in a state having a scope in length because of being somewhat longer than the strand adjacent to the detection wire under a condition where there is no load. In this case, however, the object of the present invention cannot be attained unless the detection wire is damaged at all when the adjacent strand is damaged. An excessive margin of the detection wire in length is also not desired.

Detection wires are disposed in the plural number less than the total number of the rows of the strand along the lengthwise of the strand. Since adequate evaluation of the deterioration in performance of the fiber sling cannot be made by only one detection wire, it is necessary to dispose detection wires in such a plural number that sufficient performance evaluation can be properly made. Usually, detection wires are disposed in the number of 1/5 to 1/100, preferably 1/10 to 1/50, relative to the total number of the rows of the strand.

If the detection wires are disposed in a number of 3 to 10, preferably 5±1, regardless of the total number of the rows of the strand, then it is possible to practically sufficiently detect the targeted performance deterioration of the fiber sling. If the number of the detection wires is too small, it is difficult to precisely detect the performance deterioration. Even if the number of the detection wires is too large, the labor and cost of the production merely increases. Also, in the case of too large a number of detection wires, if only one of them is cut off, then a detected change of the electrical resistance is too small and it is therefore difficult to appropriately evaluate the performance deterioration of the fiber sling.

[Sheath]

A sheath functions to cover the outer circumference of the detection wire to protect it.

A material of the sheath is required to have strength and durability so as to perform the protective function for the detection wire. However, it is to be noted that the object cannot be attained unless a detection wire comes down even if the strand is damaged. Usually, a more fragile material than the strand is used. An insulating material is effective for preventing the detection wires from coming into contact with each other to thus be electrically through each other.

Similarly to the detection wire and the strand, the sheath is also required to be so flexible as to be deformed easily. The sheath may be integrally joined to the detection wire. However, if the sheath can be deformed, move, stretch and contract separately from the detection wire, the function of the detection wire is little spoiled.

A flexible tube made of a synthetic resin or a fiber material may be used as the sheath.

<Braided Rope>

As a material of the sheath, a braided rope may be used.

The braided rope is obtained by braiding and knitting fiber filaments in a way such that the braided and knitted fiber filaments are allowed to intersect spirally with each other so as to form a cylinder as the whole. The braided rope is excellent in flexibility in case of application in addition to excellent durability. Since the detection wire can be disposed in a central space of the braided rope, the detection wire can be contained and protected favorably. A conventional manufacturing technology for a braided rope may be applied to a structure and a manufacturing method of the braided rope. An inner diameter of the braided rope may be set within a range of 1 to 5 mm.

For a material of fiber filaments constituting a braided rope, usual synthetic fibers or natural fibers may be used. A common material to that of the strand or annular protective bag may be also used. In this case, however, so high a load capacity as that of the strand is not required. Specifically, a synthetic fiber such as nylon, polyester, and polypropylene may be used.

[Detection Terminals]

The detection terminals are electrical members which abut upon measuring terminals or measuring rods of an electric measuring instrument to measure electrical resistance. A terminal structure for electrical measurement in general electrical equipment may be used.

The detection terminals are electrically connected to end portions of the plural number of detection wires disposed in the fiber sling. In this case, if all the end portions of the detection wires are on the same position, the detection terminals may be disposed on that position.

Basically, detection terminals may be physically connected to an electroconductive material of detection wires in contact with it. Or, alternatively, the connection may be made by soldering or brazing. The detection terminals may have a snap terminal connector structure.

Only one pair of detection terminals is usually provided wherein all the detection wires are electrically connected to the one pair of detection terminals. It is also possible to make an arrangement such that: the detection wires are divided into a plurality of sets, and a pair of detection terminals is provided to every set of detection wires. In this case, a selection from among the detection terminals to measure the electrical resistance makes it possible to distinctively evaluate to which set of detection wires a damaged or performance-deteriorated circulation row of the strand is adjacent.

In order to measure the electrical resistance from the outside of the sling, the detection terminals need to be exposed to the outer surface of the annular protective bag constituting the outer circumference of the sling. The whole of the detection terminals may be exposed or only a part thereof required for measurement of the electrical resistance may be exposed. It is better to dispose the connected portion between the detection terminal and the detection wire inside the annular protective bag, because, in such a case, little damage or corrosion of the connected portion occurs.

Specifically, detection terminals of a shape such as of a plate may be fixed to the annular protective bag by means such as of bonding or sewing. Rope-shaped detection cords connected to the detection wires may be extended outside the annular protective bag. There can also be adopted a structure such that detection wires are exposed to inside a hole made in the annular protective bag, detection terminals may be exposed.

A detachable cover or lid may be provided where detection terminals are exposed to the outer surface of the annular protective bag. As a result, during usual use of the sling, it is possible to prevent detection terminals from coming into contact with a suspended object or from being damaged by such as rain or a corrosive atmosphere. It is also possible that: the annular protective bag is doubled where a detection wire is disposed, so that this detection terminal may be placed between an inner bag and an outer bag which can be freely opened and closed.

A detection terminal may be provided with such a structure as can engage or hook up with a measuring terminal or rod of an electrical resistance measuring instrument so as to be able to detachably fix it.

[Resistance Element]

A part of the detection wires which connect the detection terminals can be provided with resistance elements wherein each of the resistance elements has a sufficiently higher resistance than each of the detection wires.

By incorporating the resistance elements, the resistance value through the overall length of one detection wire becomes large, so the change of the resistance value between the detection terminals in the case of the cutting-off of one detection wire becomes large. As a result, the performance deterioration of the fiber sling comes to be detected as a clear change of the resistance value.

As the resistance element, there can be used such as resistors and resistance chips being used for conventional electric circuits. A linear or axial resistance element is easily disposed along a detection wire. The resistance value of the resistance element is set so that, when the electrical resistance between the detection terminals is measured, a change of the resistance value occurring in the case of the cutting-off of one detection wire will clearly be indicated. Usually, the resistance value of the resistance element may be set in the range of 10 to 200 Ω. It can be set to be about 10 to about 100 times the resistance value through the overall length of an electroconductive wire constituting one detection wire. It is also possible to combine a plural number of resistance elements and to set their total resistance value in the above range.

On whatever position along one detection wire the resistance element may be disposed, the overall resistance value is unchanged. Usually desirable is a position which facilitates the handling during the production and prevents the application of an excessive load to the resistance element during the use and is near a detection terminal. It is also possible to connect a detection terminal and a detection wire by terminals of the opposite ends of a resistance element. If the resistance element is contained inside the sheath, then the resistance element is protected by the sheath.

[Reinforcing Core Wire]

The reinforcing core wire is disposed along a detection wire inside a sheath and thereby functions to reinforce these detection wire and sheath.

For a material of the reinforcing core wire, there may be used a common fiber material to that of the strand or sheath. Thicker or stronger filaments than those for knitting and weaving the strand can be used. Metallic wires, glass fibers, carbon fibers and the like may also be used.

The reinforcing core wire may be integrally joined to the detection wire or, alternatively, only inserted in and passed through a central space of the sheath along the detection wire. The reinforcing core wire may be provided to all the detection wires or to only a part of the detection wires.

[Method for Evaluating Performance]

An operation for evaluating the performance of the sling can be implemented in order to confirm the performance immediately after manufacturing the sling. After the sling has been used for a certain period of time, the operation may be carried out in order to confirm to what degree the performance has been deteriorated due to the use. There is also a case where the performance evaluation is implemented as a periodic inspection such as every month. There is also a case where, such as after the sling has been used under a severe condition or when an unexpected load has been applied, it is confirmed whether or not there is damage to the sling. After the performance guarantee term having been set at the time of the design or sale has passed, the performance evaluation is also carried out for judging whether or not it is possible to further continue to use the sling.

<Measurement of Electrical Resistance>

In order to effect the performance evaluation of the sling, an electrical resistance R between a pair of detection terminals provided to the sling is measured. The measurement operation may be made by the use of a usual tester or electrical resistance measuring instrument. If it is sufficient to simply confirm that the performance evaluation of the sling is not below the predefined performance, it is also possible to use a simple electrical resistance measuring instrument which does not indicate values of electrical resistance, but simply informs a person, by lighting a lamp or the like, that the electrical resistance has exceeded a definite value. A change in the electrical resistance R may be distinctively indicated by such as the number of lighted lamps according to a plural number of levels.

<Evaluation of Performance>

Performance decrement of the sling is evaluated from an measured electrical resistance R.

A change in the electrical resistance R can be evaluated as an increment or decrement amount or an increment or decrement ratio from a preset reference electrical resistance.

As the reference electrical resistance, there can be adopted a synthetic resistance value which can be theoretically calculated based on such as the material of the detection wire, the electrical resistance value per unit length of the detection wire, and the number and lengths of the detection wires connected at the detection terminals. Or, alternatively, there can also be adopted an electrical resistance value between detection terminals measured with respect to a sling confirmed as a good product immediately after manufacturing. An average value or a medium value of electrical resistance values measured with respect to a plurality of slings of the same type may also be used.

As the reference electrical resistance, there can be adopted a reference electrical resistance $R_0=r_0/n_0$ calculated from an electrical resistance $r_0$ per one detection wire provided to the sling and the number $n_0$ of the detection wires. This calculating formula is derived from an electrical theory and represents a synthetic resistance of the case where resistance components are connected in parallel.

It is enough that the electrical resistance $r_0$ per one detection wire is measured with respect to any one of detection wires if all the detection wires provided to the sling have the same length. There is no problem even if there is a difference between lengths of the detection wires to such a degree as can be ignored from the industrial point of view. If an electrical resistance value per unit length of a detection wire is already known, the electrical resistance $r_0$ can be calculated from the length of the detection wire. Or, alternatively, it may be calculated from the design data in advance.

If a resistance element is incorporated in a detection wire, then the electrical resistance $r_0$ per one detection wire is a value of the sum total of an electrical resistance $r_1$ proportional to the length of the detection wire and an electrical resistance $r_2$ of the resistance element. That is to say, $r_0=r_1+r_2$.

The aforementioned measured electrical resistance R is represented by $R=r_0/n$ from the number n of detection wires which are not damaged at that time. It can be evaluated that the performance of the fiber sling at the time when the electrical resistance R was measured has decreased to $R_0/R$ of reference performance. If $R=R_0$, it can be evaluated that there is no decrease in performance.

The term "reference performance" means herein a load capacity or lifting ability of the fiber sling in a condition where the reference electrical resistance $R_0$ has been measured. Or, alternatively, the reference performance may be a load capacity or a lifting capacity possessed either at the time of the design of the fiber sling or before the use of the fiber sling immediately after its production. In many cases, the designed load capacity or lifting weight of the fiber sling includes a safety factor. However, either of performance including the safety factor and performance not including the safety factor may be adopted as the reference.

It can be decided from use conditions or safety standard of the fiber sling how high proportion or percentage of the reference performance would enable the use of the fiber sling. Based on the aforementioned $R_0/R$ value, it can be judged whether the continuing use of the fiber sling is possible or not. From the use period of until the measurement and from the $R_0/R$ value, there can be forecasted the following: a future time-passage performance deterioration rate, a life time, and disposal timing of the fiber sling.

<Detection Wires and Performance of Fiber Sling>

As aforementioned, the relationship among the reference electrical resistance $R_0$, the electrical resistance R at the time of the performance evaluation measurement, and the numbers $n_0$ and n of electrically-through detection wires is decided from the electrical theory.

A fact that the number $n_0$ of electrically-through detection wires has become n at the time of the measurement and, as a result, $(n_0-n)$ detection wires has become electrically non-through means that the $(n_0-n)$ detection wires has snapped. There is a high possibility that the strand row adjacent to such detection wires may also be damaged or broken. If the number of broken wires of the detection wires which can be considered to be substantially uniformly disposed in the fiber sling is $(n_0-n)$, it can be presumed from the probability that: also as to the strand, $(n_0-n)/n_0$ of all the strand rows are damaged, and the ratio of currently normal strand rows is $n/n_0$.

It can be considered that the aforementioned reference performance is not exerted unless all the predetermined total rows of the strand function effectively. If the number of substantial rows of the strand becomes $n/n_0$, it can be estimated that the performance has decreased to $n/n_0=R_0/R$ of the reference performance.

Under conditions where the distributions of the detection wires and of the strand in the fiber sling and the burden of the load can be regarded as substantially uniform, then the evaluation of the fiber sling performance by the above estimation can be made with a credible precision being sufficiently reliable from the industrial point of view.

For instance, it is a case like the above-described round sling where the strand rows are disposed randomly in a state where the strand rows are freely movable one another inside the annular protective bag. In an application mode of the round sling, there is scarcely a case where only a specified position in the circumferential direction of the fiber sling always comes into contact with a heavy load, so that the burden of the load can be considered to be applied uniformly to each row of the strand.

For instance, under conditions like a belt sling where the respective positions of the rows of the strand are fixed and where a great load therefore tends to be applied always to a part of the rows such as end sides, there may be a case where the snapping of detection wires does not correspond to the damage to the strand precisely in probability. However, if detection wires are disposed on equivalent positions every definite number of rows with respect to the rows of the strand, it can be estimated that a ratio of electrically-through detection wires almost corresponds to a ratio of the number of non-damaged strand rows.

Incidentally, there may be a possibility that: the correlation between the number of the electrically-through detection wires or of the non-damaged strand rows and the performance of the fiber sling is strictly not such a linearly proportional relationship as aforementioned, but a relationship represented by a higher-order function. In this case, the performance or its decreasing rate of the fiber sling can be represented by a high-order function F $(R_0/R)$ or F (R) of the above-described $(R_0/R)$. Such a function F can be determined from experimental results as to many fiber slings obtained under different manufacturing conditions or from theories in dynamics of materials or in destruction engineering.

EFFECTS OF THE INVENTION

Since the fiber sling according to the present invention is provided with the aforementioned electroconductive detection wires, the aforementioned sheaths for protecting the detecting wires, and the aforementioned detection terminals connected to the opposite ends of the detection wires in addition to the basic structure such that an annulus of the strand circulated to form a plurality of rows is contained in a protective bag having a hollow annular shape, it can easily and accurately be evaluated whether or not the round sling maintains sufficient performance for being used.

Namely, if, when an electrical resistance between a pair of detection terminals is measured, there is seen an increase in the resistance value, then it means that there is a breaking down of detection wires in numbers corresponding to the increased resistance. From a fact that the detection wires are damaged to such a degree that they break down, it is found that there is damage also to strand rows disposed along the detection wires. Accordingly, if a change in electrical resistance between detection terminals is observed, then the ratio of damaged strand rows in the whole round sling, in other words, the degree of the damage to the fiber sling, can be known with a practically sufficient precision.

For instance, the degree of the damage to the strand inside the round sling can be easily and surely evaluated by only measuring an electrical resistance between detection terminals every definite use period of time. Such as the life time, the timing for exchange, and the limitation of the load can be appropriately set on the round sling.

EXPLANATION OF THE SYMBOLS

Figure 1:
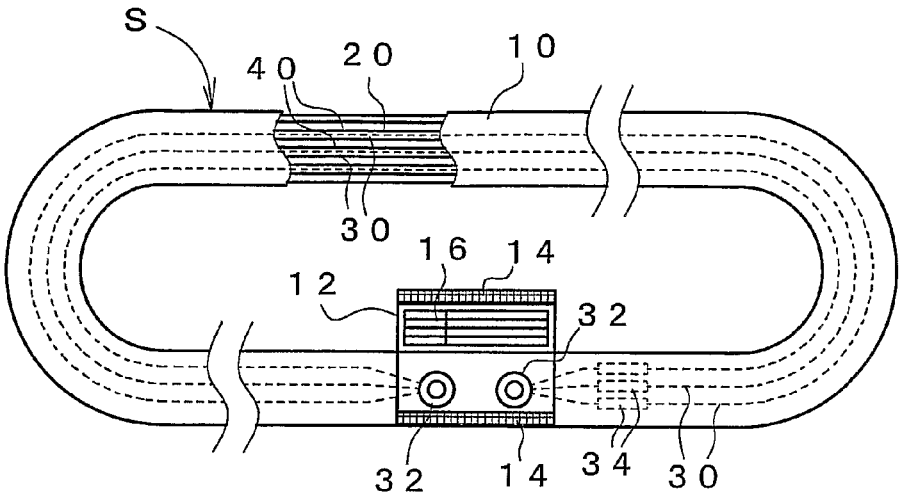
FIG. 1 is a whole constructional view of a round sling illustrating a mode for carrying out the present invention.

10: Annular protective bag
12: Covering piece
14: Tangling fastener
16: Indication label
20: Strand
30: Detection wire
32: Detection terminal
34: Resistance element
40: Sheath
42: Reinforcing core wire
S: Round sling

DETAILED DESCRIPTION OF THE INVENTION

A fiber sling shown in FIGS. 1 to 5 is provided with detection wires and a structure relating thereto in addition to the same basic structure as those of conventional round slings.

[Basic Structure]

The basic structure of a round sling S comprises a strand 20 and an annular protective bag 10.

Figure 4:
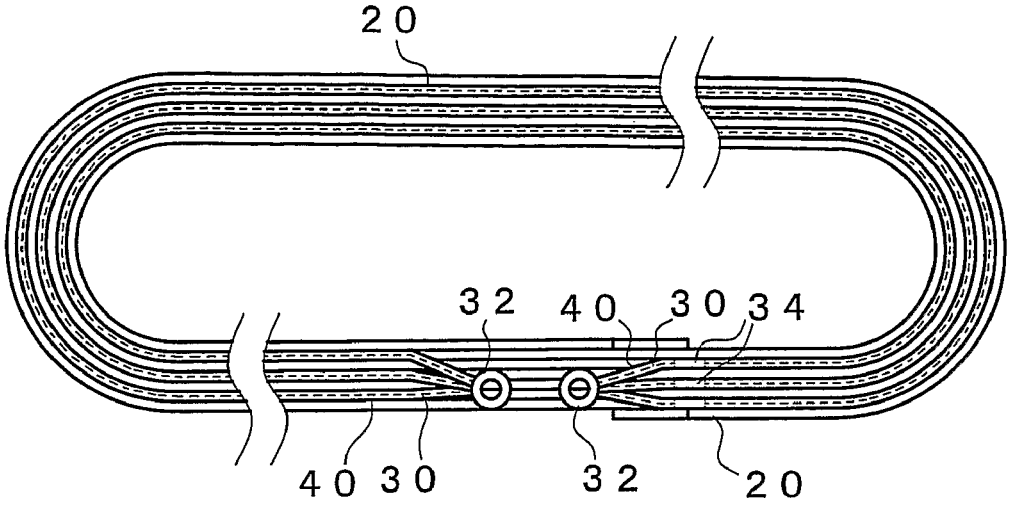
FIG. 4 is a whole constructional view in a state where the annular protective bag is removed.
Figure 5:
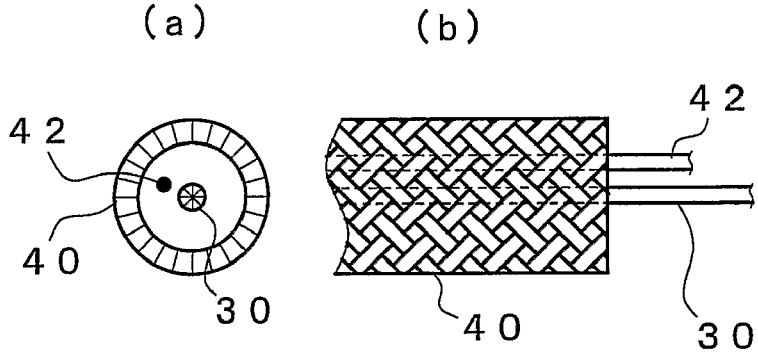
FIG. 5 is an enlarged sectional view (a) and a side constructional view (b) showing a structure relating to a detection wire.

As shown in detail in FIGS. 4 and 5, the strand 20 is constituted by a process in which a plurality of high-strength fiber filaments such as PBO fiber are loosely twisted and then circulated by a plural number of laps into an annular shape. Such circulated rows of the strand 20 are arranged in parallel in a plural number of rows.

Figure 2:
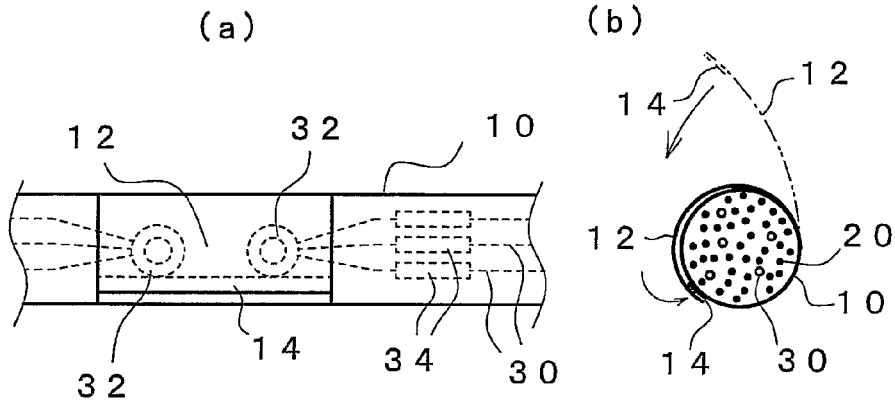
FIG. 2 is an enlarged constructional view (a) and a schematic sectional view (b) showing a main part in a state where a covering piece is closed.
Figure 3:
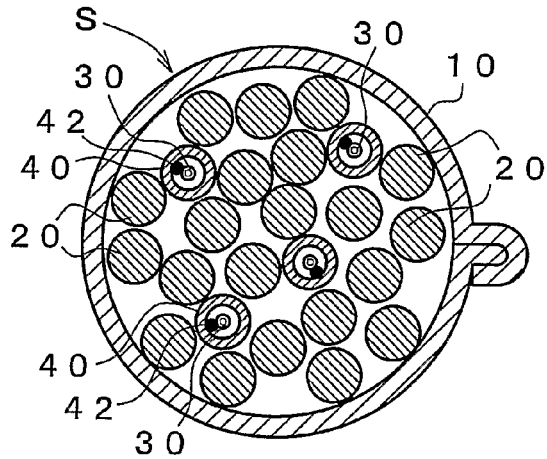
FIG. 3 is an enlarged sectional view showing the round sling.

As shown in FIGS. 1 to 3, the strand 20 such that a plural number of rows are arranged in parallel to form an annulus as a whole is contained in a hollow annular protective bag 10 in a condition where the rows can move without being bound to one another. As shown in FIG. 3, the annular protective bag 10 is formed in a hollow annular shape by: rounding a band-shaped textile fabric, made of the same high-strength fiber filaments as those of the strand 20, in a way to overlap the side end edges of the fabric on each other; and then sewing the overlapped portions together. The strand 20 is not fixed to the annular protective bag 10, but can freely move inside the annular protective bag 10. In addition, a lap length of the annular protective bag 10 is set so as to be the same as or a little longer than that of an annulus constituted by the strand 20. If a tensile strength is applied to the round sling S, a resistance force against the tensile strength is exerted by the strand 20, so that substantially no external force in the tensile direction acts on the annular protective bag 10. Thus, the load-resistant performance of the round sling S is borne basically by the annulus of the strand 20.

Such a structure itself of the round sling S comprising the strand 20 and the protective bag 10 is an already known structure.

[Structure of Detection Wires]

As shown totally in FIG. 4, the round sling has a plurality of detection wires 30 comprising urethane-covered copper wires (diameter: 0.3 mm) which are disposed along the annulus of the strand 20.

As shown in detail in FIG. 5, the outer circumference of a detection wire 30 is covered with a sheath 40 comprising a braided rope. The sheath 40 comprising the braided rope is obtained by knitting and weaving spirally fiber filaments across each other so as to form a cylinder as a whole. Inside the sheath 40, a reinforcing core wire 42 is disposed along the detection wire 30 to reinforce the detection wire 30 and the sheath 40.

As shown in FIG. 3, the detection wires 30 are disposed in a plural number smaller than the total number of the rows in the annulus of the strand 20 being used for the round sling S. In FIG. 3, the total number of the rows of the strand 20 is 23, while the number of the detection wires 30 being disposed is 4. In FIGS. 1 and 4, only three detection wires 30 thereof are shown.

As shown in FIGS. 4 and 5, the detection wires 30 are disposed over almost the whole circumference of the strand 20, and further the opposite ends of the detection wires 30 protrude from the inside to the outside of the strand 20. The protruded ends of the detection wires 30 are connected to eyelet-annulus-shaped detection terminals 32 and 32 made of a copper material. All the one-side ends of the plural number of detection wires 30 are connected to one of the detection terminals 32 in a lump, while the opposite-side ends of the detection wires 30 are also similarly connected to the other detection terminal 32 in a lump. A distance between the detection terminals 32 and 32 is set to be in such a degree that a measuring operation of electrical resistance can be easily made.

As shown in FIG. 1, the pair of detection terminals 32 and 32 is fixed in a state exposed to the outer surface of the annular protective bag 10. Each of the detection terminals 32 and 32 has a structure like an eyelet metal fitting. Terminal parts are fitted to each other both from the inner surface side and the outer surface side around a through hole made in the annular protective bag 10 and are thereby firmly fixed to the annular protective bag 10 and also render its inside and outside electrically through.

As shown in FIGS. 1 and 2(*a*), a resistance element 34 of about 100 Ω is incorporated on a position near a detection terminal 32 in each of the plural number of detection wires 30. Accordingly, a resistance value being measured between the opposite ends of the detection wires 30 is larger than a resistance value of the copper wires constituting the detection wires 30 by a value corresponding to the inclusion of the resistance elements 34.

A covering piece 12 is provided to the annular protective bag 10 where the detection terminals 32 and 32 are exposed. The covering piece 12 is made of the same material as that of the annular protective bag 10 and can cover the detection terminals 32 and 32 as shown in FIG. 2. The covering piece 12 is fixed to the annular protective bag 10 by a fixing means comprising such as a band-piece-shaped tangling fastener 14 attached to a tip inner surface of the covering piece 12. A tangling fastener 14 is attached also to an outer surface of the annular protective bag 10 with which the tangling fastener 14 provided to a tip end of the covering piece 12 contacts. As shown in FIG. 2(*b*), if the covering piece 12 is pressed on the outer surface of the annular protective bag 10, then a pair of tangling fasteners 14 is tangled with each other. The covering piece 12 can detachably be fixed to the annular protective bag 10.

Due to the existence of the covering piece 12, the detection terminals 32 and 32 can favorably be protected from such as force applied from the outside, friction, sunlight, and water when the fiber sling is used.

As shown in FIG. 1, an indication label 16 made of such as cloth is provided on the inner surface of the covering piece 12. Printed on the indication label 16 are directions for handling the fiber sling, particularly, matters to be attended necessary for measuring the electrical resistance between the detection terminals 32 and 32 and evaluating the results of the measurement.

For example, indications shown in the following table are made.

TABLE 1

<Example of indications on indication label>

| Resistance value Ω | Judgment |
|---|---|
| 20-52 Ω | Use is OK. |
| >104 Ω | Inspection is needed. |
| ∞ | Use is to be stopped. |

If the fiber sling is provided with such an indication label 16 as above, then it is possible to correctly and appropriately carry out the performance evaluation of the fiber sling and the operation and treatment based on this evaluation.

Specifically, if the resistance value is given in the range of 20-52 Ω when the resistance is measured, then the fiber sling is usable without problem. If the resistance value exceeds 104 Ω, then the fiber sling needs to be inspected. If the resistance value becomes infinite (∞), then none of the detection wires 30 is electrically through, so the use of the fiber sling must be stopped immediately.

[Use of Round Sling]

The round sling S can be used in the same use mode as those of conventional round slings.

For instance, if the round sling S is laid beneath a heavy load in a state where the annulus of the round sling S is folded and extended so as to be long and narrow and if clearance annuluses formed at the opposite ends of the round sling S extended upwards from the opposite ends of the heavy load are hooked on a crane's hook, then the heavy load can be hoisted.

The round sling S can be used in the same way as of conventional round slings S, for example, in a way that two round slings are used for four-point hoisting or that: through an annulus part of an end of the extended round sling S, there is passed the other end thereof, and only an annulus part of this through-passed other end is hoisted, in short, choke hoisting is carried out.

If the round sling S is continuously used under the applied load in the above way, there is a case where such as damage due to friction or damage due to fatigue occurs to the strand 20 to which the load has been applied repeatedly. Usually, damage begins gradually in one row or a small number of rows among the plural number of rows constituted by the strand 20, and then the damage proceeds to other rows, so that the number of damaged rows increases.

There may be a case where such damage of the strand 20 occurs after the annular protective bag 10 outside the strand 20 has broken or after a hole has opened in the annular protective bag. However, there is a case where only the inside strand 20 is damaged although there is no sign of damage to the annular protective bag 10.

The reason for this is because the load applied to the round sling S during its use is substantially borne only by the strand 20 and not by the annular protective bag 10. Every time the round sling S is used, a heavy load is applied to the strand 20, and the strand 20 is rubbed by such as corners of the hoisted object under the load-applied condition. Hence, the strand 20 is in a far severer loaded condition than the annular protective bag 10. Accordingly, there is a case where only the strand 20 is damaged even if no damage is done to the annular protective bag 10.

[Evaluation of Performance of Round Sling]

Damage to the annular protective bag 10 can be easily found by observation from the outside. Accordingly, if the annular protective bag 10 is damaged, it enough that the use of the round sling S is stopped, or that only the annular protective bag 10 is replaced. If the degree of damage to the strand 20 can be visually observed from a damaged portion of the annular protective bag 10, it can easily be judged whether or not the disposal or exchange of the whole round sling S is required.

However, there is a possibility of damage being done only to the inside strand 20 even if no outstanding damage is observed to the annular protective bag 10. By only the observation from the outside, the degree of damage to the strand 20 cannot be precisely evaluated.

Thus, an electrical resistance R between the detection terminals 32 and 32 exposed to the outer surface of the round sling S is measured. When the electrical resistance R is measured, conventional resistance measuring instruments such as testers in wide use can be used.

From the electrical resistance R measured, the performance of the round sling S at the present time can be evaluated.

<Method for Evaluating Performance>

An electrical resistance in a condition where no detection wires 30 are damaged, i.e. a reference electrical resistance $R_0=r_0/n$, is calculated in advance from an electrical resistance $r_0$ per one detection wire 30 provided to the round sling S and from the number n of the detection wires 30. As aforementioned, the electrical resistance $r_0$ is a value of the sum total of an electrical resistance $r_1$ of the copper wire corresponding to the length of the detection wire 30 and an electrical resistance $r_2$ of the resistance element 34.

When the performance evaluation of the round sling S is made, for example, after the round sling S has been used over a definite period of time or when the performance of the round sling S is confirmed immediately after its manufacturing, then the electrical resistance R between the detection terminals 32 and 32 is measured as described above.

If $R=R_0$, it is confirmed that: there is no damage (snapping) of the detection wires 30, and also all the rows of the strand 20 are good, so the performance of the round sling S is not deteriorated at all. Or, alternatively, it is assured that there is no product defect.

If the electrical resistance R measured is $R>R_0$, it means that a part of the detection wires 30 are snapped and are not electrically through, so the electrical resistance R has increased. A ratio of detection wires 30 being electrically through at present is $R_0/R$. It can be presumed that a part of the strand 20 is also damaged, and that a ratio of effective rows of the strand 20 is $R_0/R$. It can be evaluated that the performance of the round sling S has decreased to $R_0/R$.

If, in view of such as use conditions, designed performance, and safety factor of the round sling S, it is judged that the round sling S can be used even if the performance of the round sling S decreases to $R_0/R$, then the use of the round sling S can be continued. On the contrary, if it is judged that the round sling S is not suitable for the use, this round sling S is discarded or repaired.

If the electrical resistance R is periodically measured to determine an increment ratio of the electrical resistance R, then a performance decrement rate of the round sling S with the passage of time is found. From the results thus obtained, it is possible such as to estimate a life time, a usability period, and a disposal timing of the round sling S.

DETAILED DESCRIPTION OF THE PREFERRED EMBODIMENTS

[Specific Examples of Measurement of Resistance]

A round sling S of the following specifications was used.

<Round Sling>

Round sling S: endless type, for 25 t, lap length=10 m

Annular protective bag: polyester fabric, thickness=1.5 mm

Strand 20: PBO fiber 1670 dT×20 twisted, number of twistings=20 T/m

Detection wire 30: urethane-covered copper wire, diameter=0.3 mm, covering thickness=about 0.015 mm, strength to cutting-off=17 N, elongation=15.7%. The detection wires 30 were disposed in a number of 5 along the strand 20. A resistance element 34 of 100 Ω was connected to an end of each detection wire 30. The opposite ends of each detection wire 30 were connected to the detection terminals 32 and 32.

Sheath 40: polyester yarn 1670 dT×16 braided rope

<Measurement of Resistance>

Detection probes of a tester in wide use were applied to a pair of detection terminals 32 and 32 to measure a resistance value Ω. The atmospheric temperature of the measurement environment was in the range of 22-26° C.

The detection wires 30 were cut off one by one in sequence to measure a resistance value Ω at each stage. The measurement was carried out 4 times to determine its average value. Their results were as shown in the table below.

In the table, the [Calculated value] was determined by the following calculation.

From the nominal resistance value (0.25 Ω/m) of a copper wire constituting a detection wire 30, it follows that the resistance value of an electroconductive wire of 10 m in lap length is 2.5 Ω. It follows that the resistance value of one detection wire 30 is 100+2.5=102.5 Ω in the total sum of the resistance values of the electroconductive wire and of the resistance element. When the detection wires 30 have been cut off to the number of n, the resistance value becomes 102.5/(5−n) (Ω).

TABLE 2

<Results of measurement of resistance>

| Number of electroconductive wires cut off | Resistance value Ω: Value actually measured (4 times) | Average value | Calculated value |
|---|---|---|---|
| 0 | 20.6/20.7/20.5/20.9 | 20.7 | 20.5 |
| 1 | 25.7/25.9/25.9/25.8 | 25.8 | 25.6 |
| 2 | 34.2/34.3/34.3/34.4 | 34.3 | 34.2 |
| 3 | 51.4/51.6/51.6/51.7 | 51.6 | 51.3 |
| 4 | 102.6/102.7/102.9/102.8 | 102.8 | 102.5 |
| 5 | ∞ | ∞ | ∞ |

From the above results of the measurement, it is found that there is a clear correlation between the resistance value, between the detection terminals 32 and 32, and the number of the electroconductive wires cut off. It is also found that almost the same resistance values as the calculated values are actually measured.

It has been supported that the degree of the performance deterioration of the fiber sling can precisely be judged by measuring the resistance between the detection terminals.

Incidentally, as to the measurement of the resistance, the 4-time measurement did not make so much dispersion or so great errors. Therefore, it is found that: even if the average value is not calculated after carrying our the measurement a number of times, in other words, even if the measurement is carried out only 1 time, it is possible to make a practically sufficiently appropriate performance evaluation.

In addition, when compared with the resistance value of the electroconductive wire constituting the detection wire 30, that of the resistance element 34 less undergoes such as either an influence of the environment such as temperature or a change with the passage of time, so a relationship between the number of the cut-off detection wires 30 and the change of the resistance value is exhibited stepwise at greater intervals. Therefore, the performance evaluation is facilitated.

INDUSTRIAL APPLICATION

The present invention can be applied, for example, to round slings for hoisting a variety of heavy loads. The degree of the damage to the strand inside the round sling can be easily and surely evaluated by only measuring an electrical resistance between detection terminals every definite use period of time. Such as the life time, the timing for exchange, and the limitation of the load can be appropriately known about the round sling.

The invention claimed is:

1. A fiber sling, comprising:

a strand having a load capacity that is circulated in a plurality of laps to thus form an annulus wherein the annulus is contained in a protective bag having a hollow annular shape;

detection wires, with each of the detection wires having electroconductivity and disposed along the annulus of the strand, with the number of the detection wires being plural and less than the total number of the laps of the strand;

a sheath covering the outer circumference of each of the detection wires;

a pair of detection terminals connected electrically with the opposite ends of the plural number of detection wires and exposed to the outer surface of the annular protective bag; and reinforcing core wires disposed along the detection wires inside the sheaths.

2. The fiber sling as claimed in claim 1, wherein:

the strand is made of a synthetic fiber material selected from the group consisting of PBO, polyester, polyarylate, aramide, and high strong polyethylene;

the detection wires are made of electroconductive metallic wires selected from the group consisting of copper and copper alloys and having an outer diameter of 0.1 to 1.0 mm and are disposed in a number of 3 to 8;

the sheath is made of a braided rope prepared by knitting and weaving synthetic fiber filaments selected from the group consisting of polyester, nylon, and polypropylene into a cylindrical shape; and the annular protective bag is prepared from a textile fabric made of fiber filaments selected from the group consisting of polyester and nylon and has a hollow annular shape with an inner diameter of 10 to 200 mm.

3. The fiber sling as claimed in claim 1, further comprising:

resistance elements provided to a part of the detection wires wherein each of the resistance elements has a sufficiently higher resistance than each of the detection wires.

4. A method for evaluating a performance of a fiber sling, which is a method for evaluating a performance decrease of the fiber sling as claimed in claim 1, comprising:

a step (a) for measuring an electrical resistance R between a pair of detection terminals on the fiber sling; and a step (b) for evaluating a performance decrease of a round sling from the electrical resistance R measured in the step (a);

wherein: in step (b), it is evaluated that the performance of the fiber sling has decreased to $R_0/R$ of reference performance, from: a reference electrical resistance $R_0=r_0/n_0$ calculated from an electrical resistance $r_0$ per one of the detection wires and the number $n_0$ of the detection wires; and the measured electrical resistance R.

* * * * *